US008604374B2

(12) United States Patent
Mittelstadt

(10) Patent No.: US 8,604,374 B2
(45) Date of Patent: Dec. 10, 2013

(54) MOVEABLE CONTACT CLOSING ENERGY TRANSFER SYSTEM FOR MINIATURE CIRCUIT BREAKERS

(75) Inventor: Chad R. Mittelstadt, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 249 days.

(21) Appl. No.: 13/169,880

(22) Filed: Jun. 27, 2011

(65) Prior Publication Data

US 2012/0325632 A1 Dec. 27, 2012

(51) Int. Cl.
*H01H 23/00* (2006.01)

(52) U.S. Cl.
USPC ..... 200/401

(58) Field of Classification Search
USPC ..... 200/401, 400, 288, 50.19, 50.02, 410, 200/411, 430, 431, 428, 440–442, 318, 321, 200/324, 325, 327, 335, 6 R
See application file for complete search history.

(56) References Cited

U.S. PATENT DOCUMENTS

| | | | | |
|---|---|---|---|---|
| 4,263,492 | A | 4/1981 | Maier et al. | |
| 4,267,419 | A | 5/1981 | Maier et al. | |
| 4,295,024 | A | 10/1981 | Kamp | |
| 4,612,429 | A | 9/1986 | Milianowicz | |
| 5,192,841 | A | 3/1993 | Milianowicz et al. | |
| 5,449,871 | A * | 9/1995 | Batteux et al. | 200/401 |
| 6,072,136 | A * | 6/2000 | Wehrli et al. | 200/401 |
| 8,058,580 | B2 * | 11/2011 | Gottschalk et al. | 200/400 |
| 2005/0269195 | A1 * | 12/2005 | Brandon et al. | 200/400 |

FOREIGN PATENT DOCUMENTS

| | | | |
|---|---|---|---|
| DE | 16 65 817 | A1 | 3/1971 |
| DE | 10 2005 029059 | A1 | 12/2006 |
| EP | 1 709 660 | A1 | 10/2006 |
| FR | 2 717 617 | A1 | 9/1995 |

OTHER PUBLICATIONS

International Search Report, PCT/US2012/042421, mailed Sep. 14, 2012 (3 pages).
International Written Opinion, PCT/US2012/042421\, mailed Sep. 14, 2012 (6 pages).

* cited by examiner

*Primary Examiner* — Edwin A. Leon
*Assistant Examiner* — Anthony R. Jimenez
(74) *Attorney, Agent, or Firm* — Locke Lord LLP

(57) ABSTRACT

An energy transfer system absorbs impact forces and/or energy from a moveable conductive blade directly attached to a moveable contact in a circuit breaker. The energy transfer system includes a rotatable member and a biasing member. The rotatable member has an axis of rotation about which the rotatable member is rotatable between a first position and a second position. The rotatable member further includes a protrusion. The protrusion has an initial curved engagement surface portion, a planar engagement surface portion next to the initial curved engagement surface portion, and a final curved engagement surface portion next to the planar engagement surface portion. The biasing member biases the rotatable member towards the first position. The movable conductive blade impacts the initial curved engagement surface portion to cause the rotatable member to begin to rotate about the axis of rotation such that the moveable conductive blade then contacts the planar engagement surface portion and then the final curved engagement surface portion.

23 Claims, 8 Drawing Sheets

MOVEABLE CONTACT CLOSING ENERGY TRANSFER SYSTEM FOR MINIATURE CIRCUIT BREAKERS

FIELD OF THE INVENTION

This invention is directed generally to a circuit breaker, and, more particularly, to a circuit breaker having an energy transfer system.

BACKGROUND OF THE INVENTION

Circuit breakers provide automatic and manual current interruption to a circuit. The act of turning ON a circuit breaker and closing an electrical circuit typically involves a mechanical movement of a series of mechanical parts that results in a moveable contact making an electrical connection with a stationary contact. The mechanical movement can result in the moveable contact engaging the stationary contact with a significant impact force and energy such that the moveable contact bounces on the stationary contact prior to coming to rest thereon. The bouncing is undesirable because it can result in momentary arcing between the contacts that damage the contacts overtime and can reduce the useful life of the circuit breaker. Prior attempts to account for the bouncing include providing more durable and hefty contacts; however, this is an expensive solution because the contacts are typically made of expensive materials (e.g., silver). Other attempts to account for the bouncing involve complex mechanical arrangements that involve many additional moving components within a housing of the circuit breaker that increase costs and require a larger housing for the circuit breaker.

Thus, a need exists for an improved apparatus. The present disclosure is directed to satisfying one or more of these needs and solving other problems.

SUMMARY OF THE INVENTION

An energy transfer system of the present disclosure absorbs impact forces in a circuit breaker to reduce wear and tear on metal electrical contacts therein. The energy transfer system does so without significantly, negatively affecting the electrical connection between the contacts. The energy transfer system is relatively inexpensive as it only includes a rotatable member and a biasing member that can be retrofitted in a plurality of existing miniature circuit breakers with minimal modifications to the housings of the circuit breakers.

The energy transfer system absorbs impact forces and/or energy from a moveable conductive blade directly attached to a moveable contact in a circuit breaker. The rotatable member has an axis of rotation about which the rotatable member is rotatable between a first position and a second position. The rotatable member further includes a protrusion. The protrusion has an initial curved engagement surface portion, a planar engagement surface portion next to the initial curved engagement surface portion, and a final curved engagement surface portion next to the planar engagement surface portion. The biasing member biases the rotatable member towards the first position. The movable conductive blade impacts the initial curved engagement surface portion to cause the rotatable member to begin to rotate about the axis of rotation such that the moveable conductive blade then contacts the planar engagement surface portion and then the final curved engagement surface portion.

Additional aspects of the disclosure will be apparent to those of ordinary skill in the art in view of the detailed description of various embodiments, which is made with reference to the drawings, a brief description of which is provided below.

BRIEF DESCRIPTION OF THE DRAWINGS

The present disclosure may best be understood by reference to the following description taken in conjunction with the accompanying drawings, in which.

DETAILED DESCRIPTION OF THE ILLUSTRATED EMBODIMENTS

Although the present disclosure will be described in connection with certain preferred embodiments, it will be understood that the present disclosure is not limited to those particular embodiments. On the contrary, the present disclosure is intended to include all alternatives, modifications and equivalent arrangements as may be included within the spirit and scope of the present disclosure as defined by the appended claims.

Figure 1:
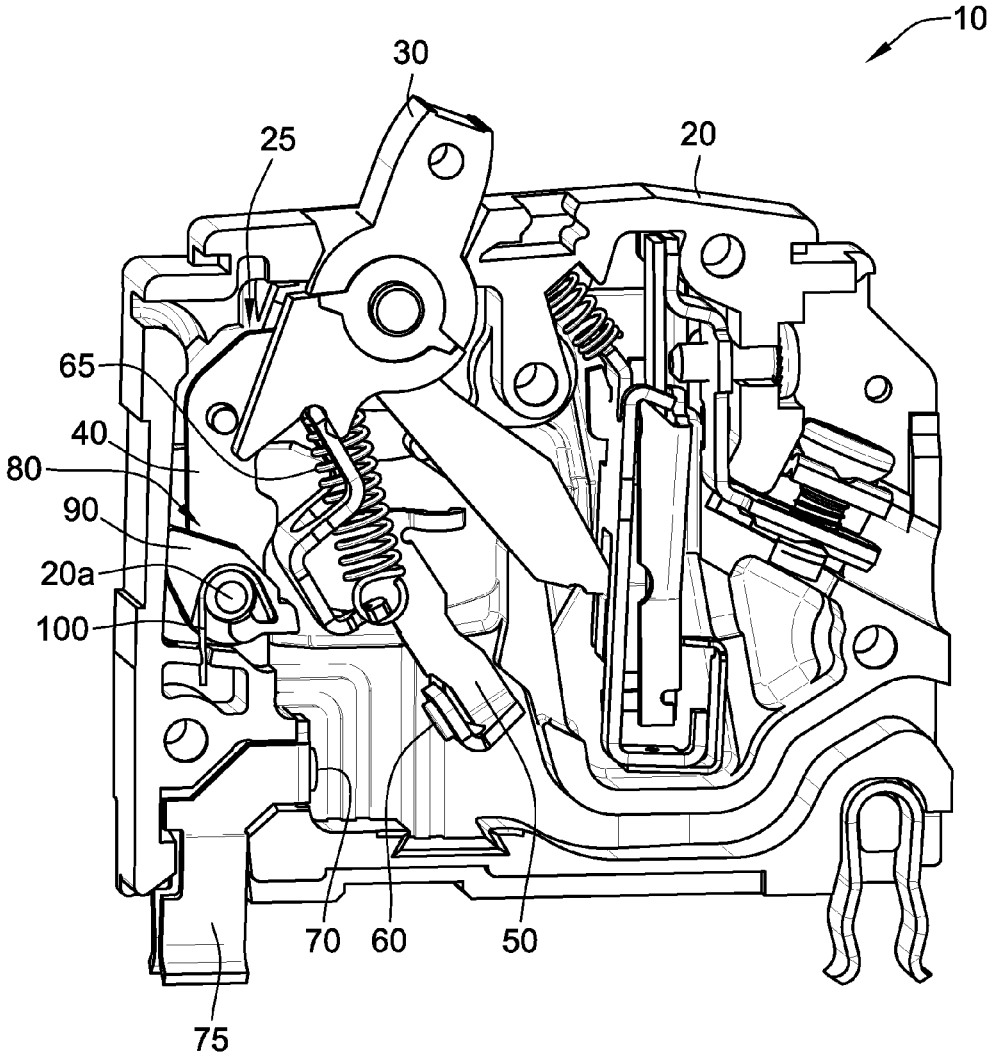
FIG. 1 is a partial perspective view of a circuit breaker having a cover removed to illustrate its inner components.

Referring to FIG. 1, a circuit breaker 10 with a cover removed (i.e., not shown) to illustrate internal components includes a housing 20, a switch assembly 25, and an energy transfer system 80. The switch assembly 25 and the energy transfer system 80 are both generally contained within the housing, except for a portion of the switch assembly 25 (e.g., an upper portion of a handle 30). Some components (e.g., bimetal, yoke, armature, terminals, etc.) of the circuit breaker 10 are omitted or not described, however, these components, which may be found in, for example, the QO® or HOME-LINE® miniature circuit breakers available from Schneider Electric USA, Inc., are not necessary for an understanding of aspects of the present disclosure.

Figure 2:
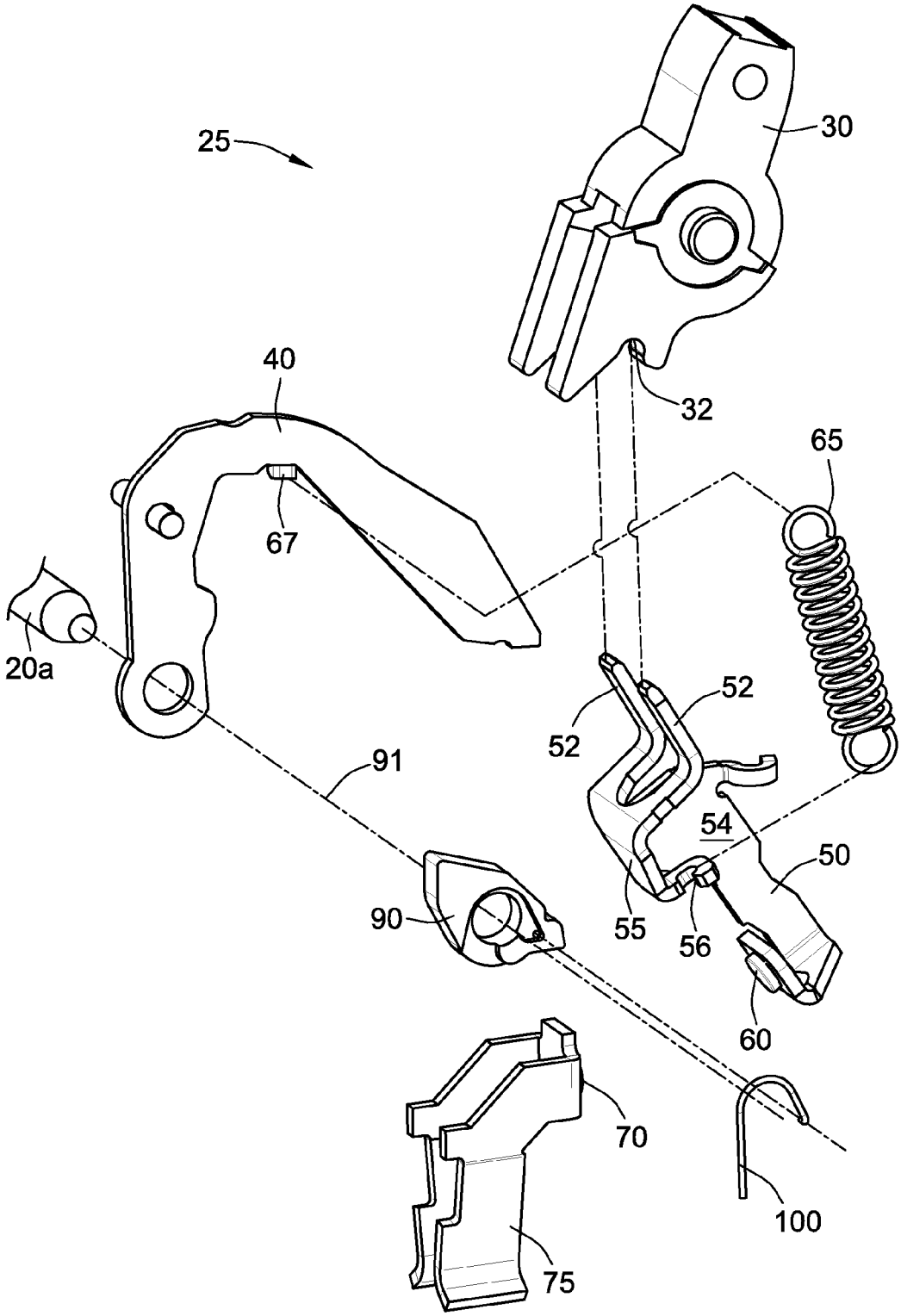
FIG. 2 is an exploded perspective view of a switch assembly of the circuit breaker of FIG. 1.

Referring to FIGS. 1 and 2, the switch assembly 25 includes a handle 30, a trip lever 40, a moveable contact blade 50, a moveable contact 60, a spring 65, a stationary contact 70, and a stationary contact jaw 75. Portions of the switch assembly 25 are operable to move to switch the circuit breaker 10 on, where current is free to flow through the circuit breaker 10, and off, where current is prevented from flowing through the circuit breaker 10. More specifically, for current to pass through the circuit breaker 10, the circuit breaker 10 is switched to a latched-ON position (FIG. 7A), meaning that the handle 30 is in an ON position (see e.g., FIG. 7A) and the trip lever 40 is in an engaged position (see e.g., FIG. 1).

The trip lever 40 can be in a tripped position (not shown) which prevents the circuit breaker 10 from being in an ON position. However, for the purposes of this disclosure, the trip lever 40 is in the engaged position as shown in FIG. 1. Thus, assuming the trip lever 40 is in the engaged position, the on/off state of the circuit breaker 10 is generally controlled by the position of the handle 30 for purposes of this disclosure. To prevent current from flowing through the circuit breaker 10, the circuit breaker 10 can be switched to a latched-OFF position, meaning that the handle 30 is in an OFF position (see e.g., FIG. 1) and the trip lever 40 is in the engaged position.

Figure 7A:
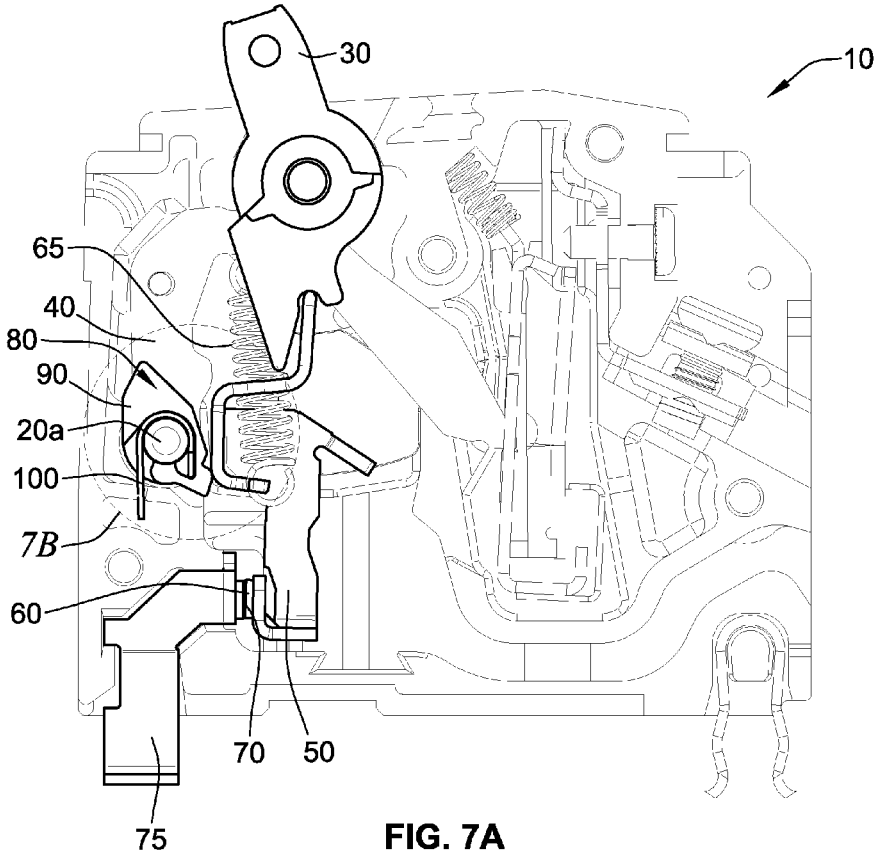
FIG. 7A is a front view of the circuit breaker of FIG. 1 in a latched-ON position.

The moveable conductive blade 50 is operatively coupled to the trip lever 40 and to the handle 30 such that the moveable conductive blade 50 is configured to move or swing from an off or first blade position (e.g., FIG. 1) to an on or second blade position (e.g., FIG. 7A) in response to the handle 30 being urged from the OFF position (e.g., FIG. 1) to the ON position (e.g., FIG. 7A). That is the OFF and ON positions of the handle 30 correspond to the first and second blade positions, respectively, of the moveable conductive blade 50. By operatively coupled it is meant that the moveable conductive blade 50 is mechanically linked to the both the handle 30 and the trip lever 40 such that movement of the handle 30 results in a corresponding movement of the moveable contact blade 50. Specifically, the moveable conductive blade 50 is coupled to the trip lever 40 via the spring 65 and the moveable conductive blade 50 is pivotally coupled to the handle 30. The spring 65 is attached and/or coupled to attachment points 56 and 67 on the moveable conductive blade 50 and the trip lever 40, respectively, to bias the moveable conductive blade 50 such that the moveable conductive blade 50 generally maintains the pivotal coupling with the handle 30. More specifically, the spring 65 biases a pair of blade arms 52 into pivotal contact with one or more handle grooves 32.

As shown in FIG. 2, the moveable conductive blade 50 includes a major blade surface 54 lying in a plane and an orthogonal blade surface 55 extending from the major blade surface 54 in a direction generally perpendicular to the plane containing the major blade surface 54. The moveable conductive blade 50 moves and/or swings with the major blade surface 54 generally remaining within the plane. The orthogonal blade surface 55 is a leading edge or surface of the moveable conductive blade 50 that contacts the energy transfer system 80 as described herein.

When the circuit breaker 10 is on, i.e., the handle 30 is in the ON position and the moveable conductive blade 50 is in the on or second blade position (e.g., FIG. 7A), current flowing into the circuit breaker 10 to the stationary contact 70 via the stationary contact jaw 75 is free to flow through the moveable contact 60, which is removably coupled to and abuts and/or electrically connects with the stationary contact 70. The moveable contact 60 is fixed to and/or directly attached to the moveable conductive blade 50 such that current is free to flow from the moveable contact 60 through the moveable conductive blade 50. When the circuit breaker is off, i.e., the handle 30 is in the OFF position and the moveable conductive blade 50 is in the off or first blade position (e.g., FIG. 1), the moveable contact 60 is disconnected or spaced away from the stationary contact 70 a sufficient distance to prevent current from flowing therethrough.

The energy transfer system 80 includes a rotatable member 90 and a biasing member 100. The rotatable member 90 is pivotally coupled to a pivot point 20*a* of the housing 20 of the circuit breaker 10. The pivot point 20*a* is shared with the trip lever 40 such that the rotatable member 90 and the trip lever 40 can pivot about the same pivot point 20*a* in the housing 20. The sharing of the pivot point 20*a* between the trip lever 40 and the rotatable member 90 is advantageous because it allows for the installation of the energy transfer system 80 into circuit breakers like circuit breaker 10 with minimal or no modifications to the circuit breaker housing and other internal components, and with no difference in the external dimensions of the housing 20. That is, a typical miniature circuit breaker, such as those offered by the Schneider Electric USA, Inc., can be retrofitted and/or internally modified to include the energy transfer system 80 of the present disclosure without increasing the outer dimensions of the housing. Maintaining the external dimensions and shape of a typical miniature circuit breaker including the energy transfer system 80 is advantageous because the circuit breaker 10 can be used in preexisting electrical enclosures (e.g., standard electrical panels in a house).

Referring now to FIGS. 3A-3D, the rotatable member 90 is rotatable between a first member position (FIG. 1) and a second member position (FIG. 7A). The rotatable member 90 has two opposing major surfaces 90*a,b* (FIGS. 3A and 3B, respectively) and a perimeter surface 90*c* extending between the opposing major surfaces 90*a,b*. The perimeter surface 90*c* circumscribes and/or extends around the entire perimeter of the rotatable member 90. The perimeter surface 90*c* is generally orthogonal (i.e., 90 degrees) to the pair of opposing major surfaces 90*a,b*, although one or more portions of the perimeter surface 90*c* can be at one or more other angles, e.g., 80 degrees, 100 degrees, etc. (not shown) with respect to the pair of major surfaces 90*a,b* of the rotatable member 90.

The major surfaces 90*a,b* are generally planar and parallel to one another, although one or more portions of the first and/or second major surfaces 90*a,b* can be non-planar. For example, the first major surface 90*a* of the rotatable member 90 includes a curved channel 95 (FIGS. 3A and 3C) that receives a portion of the biasing member 100 therein (shown in, e.g., FIG. 1) to bias the rotatable member 90 towards the first member position (e.g., FIG. 1). The channel 95 has a base portion 95*a* and a curved outer wall portion 95*b*. The channel 95 generally surrounds or circumscribes a substantial portion of an aperture 92 that extends through the rotatable member 90 between the pair of major surfaces 90*a,b*. The channel 95 provides sufficient clearance for the biasing member 100 to remain within the channel 95 during rotation of the rotatable member 90 between the first and the second member positions.

The biasing member 100 is operatively engaged with the rotatable member 90 via the channel 95 to bias the rotatable member 90 in the first member position. The biasing member 100 is also operatively engaged with the housing 20 of the circuit breaker 10. By operatively engaged with the rotatable member 90 it is meant that one of the ends of the biasing member 100 at least partially contacts the curved outer wall portion 95*b* of the channel 95 to exert a force on the rotatable member 90. It is not necessary for the biasing member 100 to be attached to the rotatable member 90 via a screw, glue, or otherwise, although such an attachment is possible in some alternatives. Alternatively, operatively engaged can mean that the biasing member 100 is integrally formed with the rotatable member 90 such that the biasing member 100 and the rotatable member 90 are a single, unitary part, such as shown, for example, in FIGS. 8A and 8B, which are described below. By operatively engaged with the housing 20 it is meant that the other of the ends of the biasing member 100 at least contacts the housing 20 to maintain the position of the biasing member 100 within the housing in at least one direction (e.g., horizontal position). It is not necessary for the biasing member 100 to be attached to the housing 20 via a screw, glue, or otherwise, although such an attachment is possible in some alternatives.

The rotatable member 90 can include an aperture or slot 96 extending from the base 95*a* of the channel 95 towards the second major surface 90*b* of the rotatable member 90. The aperture or slot 96 extends in a direction generally orthogonal to the pair of major surfaces 90*a,b*. The aperture or slot 96 can receive a portion of the biasing member 100 (e.g., one of the ends of the biasing member 100) to aid in maintaining the position of the biasing member 100 within the channel 95. Comparing FIGS. 3*b* and 3C, the aperture or slot 96 does not extend through the second major surface 90*b*, although that is possible in some alternative implementations.

The perimeter surface 90*c* of the rotatable member 90 includes a housing engaging surface portion $\mathbf{90}c_1$. The housing engaging surface portion $\mathbf{90}c_1$ is generally planar although it can be curved, polygonal, substantially planar, or a combination thereof. The biasing member 100 biases the rotatable member 90 such that the housing engaging surface portion $\mathbf{90}c_1$ abuts an inside wall of the housing 20 of the circuit breaker 10 (FIG. 1) when the rotatable member 90 is in the first member position. Thus, a portion of the inside wall of the housing 20 of the circuit breaker 10 acts a stopper that limits the rotation of the rotatable member 90 due to the biasing member 100.

The rotatable member 90 includes an axis of rotation 91 about which the rotatable member 90 is rotatable between the first and the second member positions. The rotatable member 90 includes the aperture 92 that rotationally couples about the pivot point 20*a*. That is, the rotatable member 90 is removably and rotationally coupled to the housing 20 of the circuit breaker 20 such that the pivot point 20*a* is generally positioned within and through the aperture 92 of the rotatable member 90. The axis of rotation 91 extends through the center of the aperture 92 and generally through a center of the pivot point 20*a*.

Figure 3B:
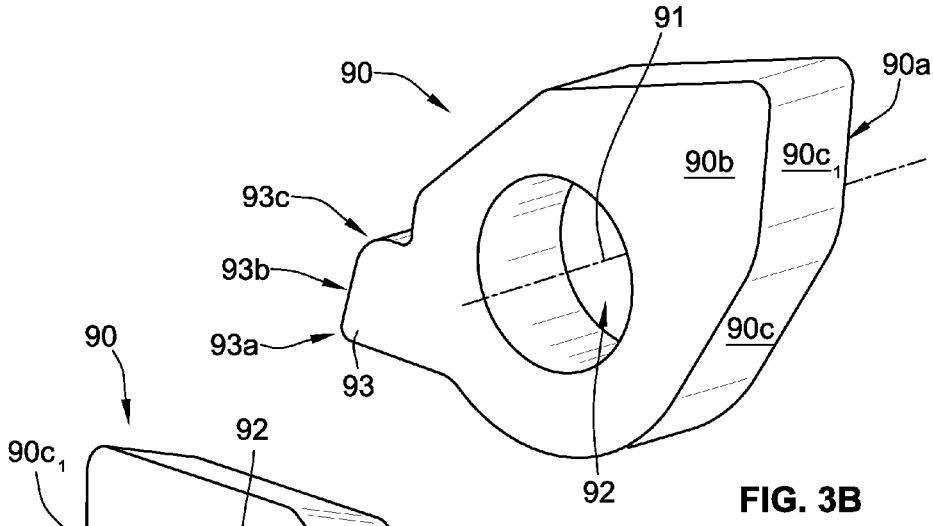
FIG. 3B is a rear perspective view of the rotatable member of FIG. 3A.
Figure 3A:
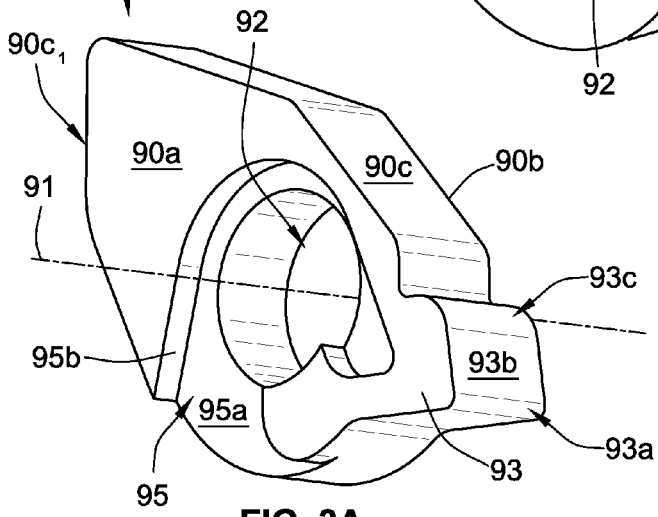
FIG. 3A is a front perspective view of a rotatable member of the circuit breaker of FIG. 1.
Figure 3C:
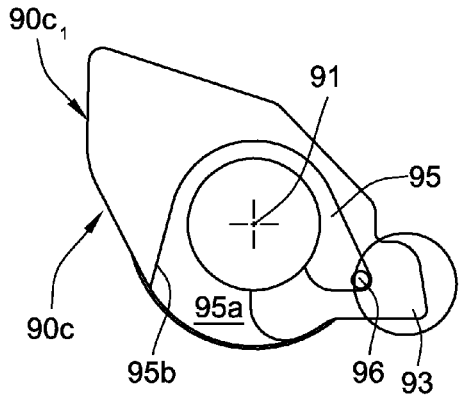
FIG. 3C is a front view of the rotatable member of FIG. 3A.
Figure 3D:
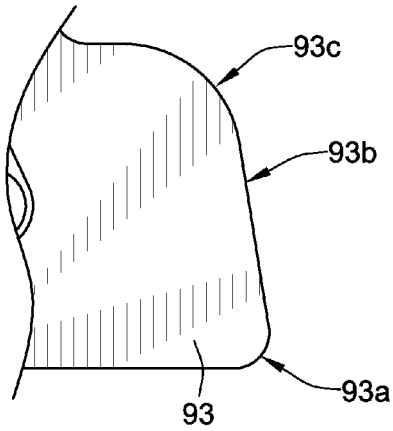
FIG. 3D is an enlarged front view of a protrusion of the rotatable member of FIG. 3C.

The rotatable member 90 includes a protrusion 93 that extends radially with respect to the axis of rotation 91. Put another way, the protrusion 93 extends radially from the perimeter surface 90*c* of the rotatable member 90. As best shown in FIG. 3D, the protrusion 93 includes an initial curved engagement surface portion 93*a*, a planar engagement surface portion 93*b*, and a final curved engagement surface portion 93*c*. The initial and final curved engagement surface portions 93*a,c* are each positioned next to or directly adjacent to opposite ends of the planar engagement surface portion 93*b*. The final curved engagement surface portion 93*c* is distal from (e.g., not touching and separated by the planar surface 93*b*) the initial curved engagement surface portion 93*a*. The surface portions 93*a-c* provide a continuous surface along a portion of the perimeter surface 90*c* of the rotatable member 90 for engagement with the moveable conductive blade 50 described herein. The perimeter surface 90*c* of the rotatable member 90 circumscribes about the entire perimeter of the rotatable member 90 such that the perimeter surface 90*c* includes each of the engagement surface portions 93*a-c* of the protrusion 93.

Figure 5A:
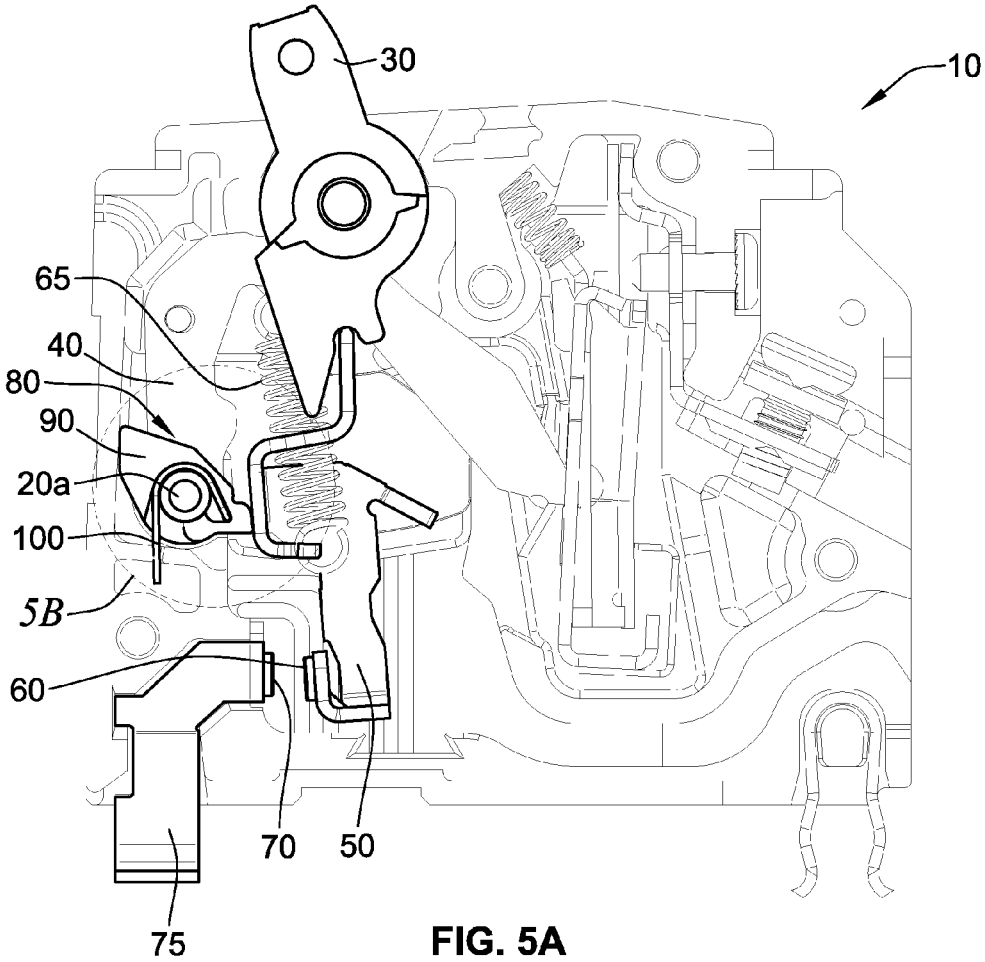
FIG. 5A is a front view of the circuit breaker of FIG. 1 in a first instantaneous-intermediate position.
Figure 5B:
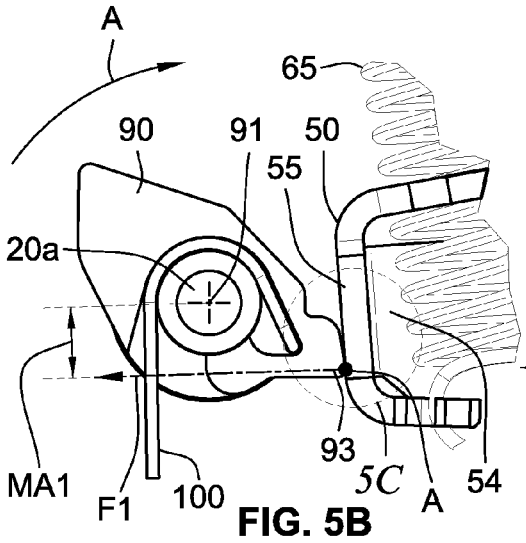
FIG. 5B is an enlarged partial front view of an energy absorbing system and a portion of a moveable conductive blade of the circuit breaker of FIG. 5A.
Figure 5C:
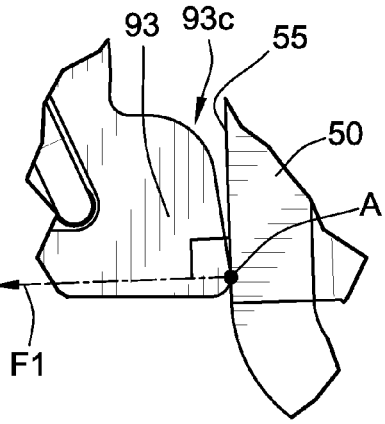
FIG. 5C is an enlarged partial front view of a protrusion of a rotatable member of the energy absorbing system and a portion of the moveable contact blade of FIG. 5B.
Figure 6A:
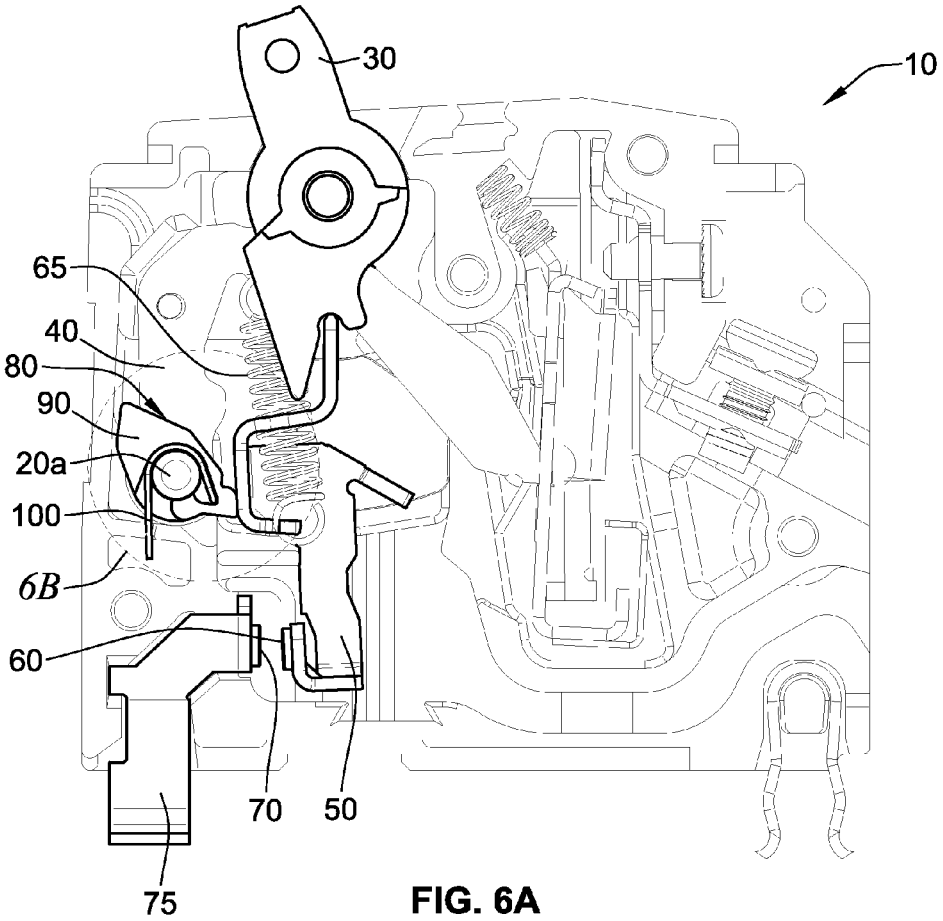
FIG. 6A is a front view of the circuit breaker of FIG. 1 in a second instantaneous-intermediate position.
Figure 6B:
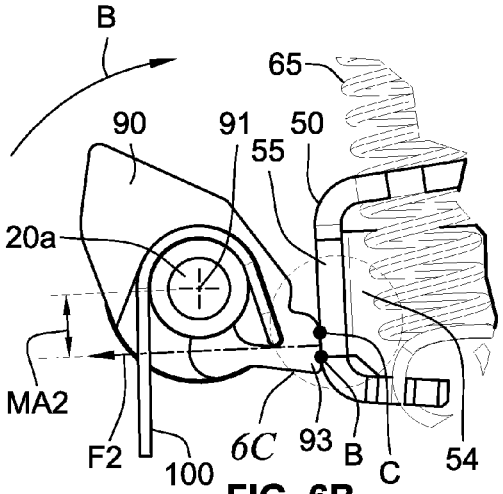
FIG. 6B is an enlarged partial front view of an energy absorbing system and a portion of a moveable conductive blade of the circuit breaker of FIG. 6A.
Figure 6C:
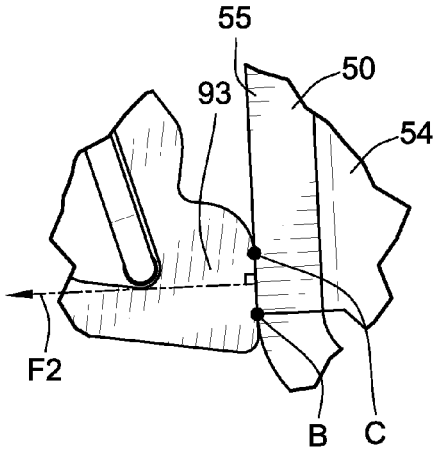
FIG. 6C is an enlarged partial front view of a protrusion of a rotatable member of the energy absorbing system and a portion of the moveable contact blade of FIG. 6B.
Figure 7B:
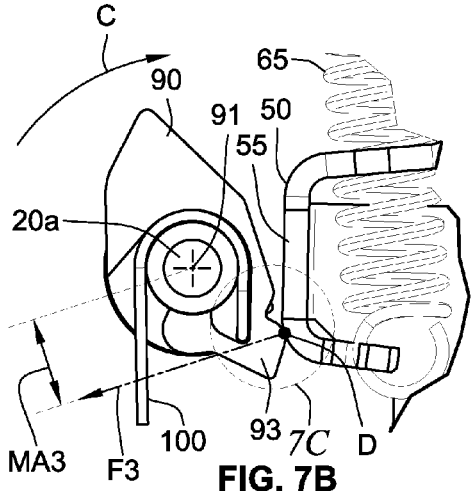
FIG. 7B is an enlarged partial front view of an energy absorbing system and a portion of a moveable conductive blade of the circuit breaker of FIG. 7A.
Figure 7C:
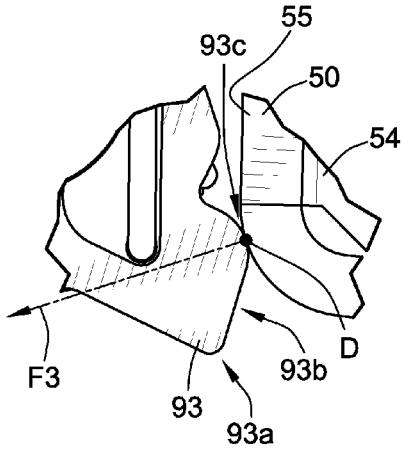
FIG. 7C is an enlarged partial front view of a protrusion of a rotatable member of the energy absorbing system and a portion of the moveable contact blade of FIG. 7B.

Generally referring to FIGS. 4A-7C, the rotatable member 90 is positioned adjacent to the moveable conductive blade 50 such that in response to the handle 30 being switched from the OFF position (FIG. 4A) to the ON position (FIGS. 5A, 6A, and 7A), the moveable conductive blade 50 is moved from the first blade position (FIGS. 4A-4C) to the second blade position (FIGS. 7A-7C). During the movement of the moveable conductive blade 50 from the first blade position (FIG. 4A) to the second blade position (FIG. 7A), the moveable conductive blade 50 and the rotatable member 90 pass through a plurality of instantaneous-intermediate positions. Two examples of such instantaneous-intermediate positions are shown in FIGS. 5A-5C and 6A-6C, respectively.

A first one of the instantaneous-intermediate positions (FIGS. 5A-5C) is when the orthogonal blade surface 55 of the moveable conductive blade 50 initially impacts and contacts the protrusion 93 of the rotatable member 90. Specifically, the orthogonal blade surface 55 of the moveable conductive blade 50 initially contacts the initial curved engagement surface portion 93*a* (FIGS. 5A-5C) which causes the rotatable member 90 to begin to rotate about the axis of rotation 91 from the first member position such that the moveable conductive blade 50 then contacts the planar engagement surface portion 93*b* (FIGS. 6A-6C), which is a second one of the instantaneous-intermediate positions. The moveable conductive blade 50 continues to engage the rotatable member 90 which continues to rotate such that the orthogonal blade surface 55 of the moveable conductive blade 50 then contacts the final curved engagement surface portion 93*c* (FIGS. 7A-7C), where the rotatable member 90 is in the second member position.

Figure 4A:
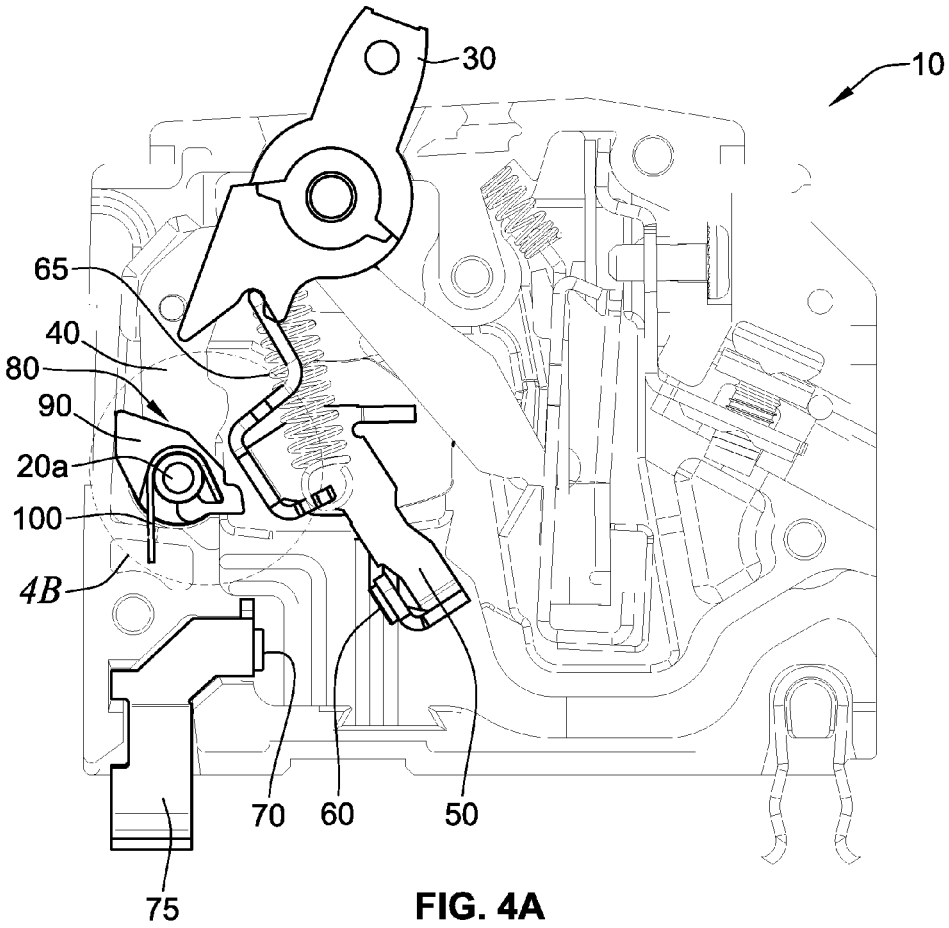
FIG. 4A is a front view of the circuit breaker of FIG. 1 in a latched-OFF position.
Figure 4B:
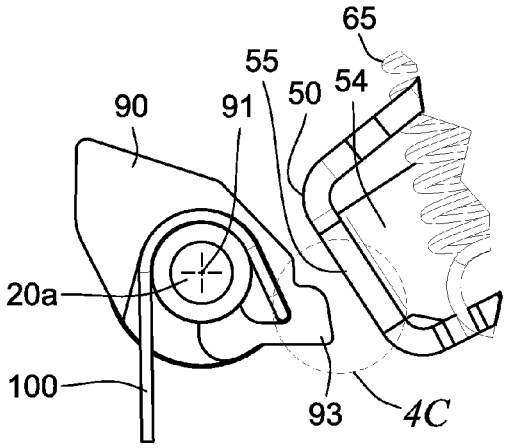
FIG. 4B is an enlarged partial front view of an energy absorbing system and a portion of a moveable conductive blade of the circuit breaker of FIG. 4A.
Figure 4C:
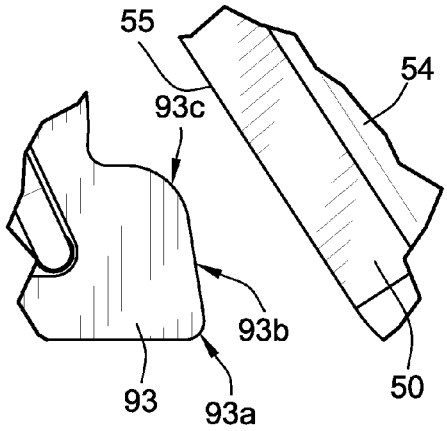
FIG. 4C is an enlarged partial front view of a protrusion of a rotatable member of the energy absorbing system and a portion of the moveable contact blade of FIG. 4B.

Referring to FIGS. 4A-4C, the circuit breaker 10 is shown in the latched-OFF position as the handle 30 is in the OFF position, the moveable conductive blade 50 is static (i.e., not moving) and in the first blade position, and the rotatable member 90 is static (i.e., not rotating or rotated 0 degrees with respect to the first member position) and in the first member position. In the latched-OFF position, current is prevented from flowing through the circuit breaker 10 as the moveable contact 60 is not electrically connected with the stationary contact 70 (FIG. 4A).

The moveable conductive blade 50 does not contact or touch the protrusion 93 of the rotatable member 90 when the circuit breaker 10 is in the latched-OFF position. Additionally, the orthogonal blade surface 55 is not moving (i.e., static) and thus does not exert any force on the rotatable member 90.

Referring to FIGS. 5A-5C, the circuit breaker 10 is shown in the first instantaneous-intermediate position as the handle 30 is in the ON position, the moveable conductive blade 50 is dynamic (i.e., moving and/or swinging from the first blade position towards the second blade position) and in a first instantaneous-intermediate-blade position, and the rotatable member 90 is static (i.e., not rotating or rotated 0 degrees with respect to the first member position) and in a first instantaneous-intermediate-member position, which is the same as the first member position. In the first instantaneous-intermediate position, even though the handle 30 is in the ON position, current is prevented from flowing through the circuit breaker 10 as the moveable contact 60 is not electrically connected with the stationary contact 70 (FIG. 5A).

As best shown in FIG. 5C, the orthogonal blade surface 55 initially contacts the initial curved engagement surface portion 93*a* of the protrusion 93 at point A. This contact is tangential at point A as the portion of the orthogonal blade surface 55 that contacts the initial curved engagement surface portion 93*a* is substantially planar or flat and the initial curved engagement surface portion 93*a* is curved. This tangential initial contact results in an impact/dynamic force F1 being exerted on the protrusion 93 by the moveable conductive blade 50 in a first force direction through point A. The force F1 and its direction create a moment or torque about the axis of rotation 91 in the direction of arrow A (FIG. 5B) such that the rotatable member 90 begins to rotate from the first member position towards the second member position in the direction of arrow A; however, as shown in FIGS. 5A-5C, the rotatable member 90 is still static and in the first member position. The moment has a moment arm length MA1 that is defined as a distance between a line through the force F1 and a parallel line through the axis of rotation 91.

It is advantageous for the initial impact between the moveable conductive blade 50 and the protrusion 93 to be tangential because the direction of the force F1 is more accurately repeated with a single contact point (as opposed to a surface-to-surface contact with many/infinite contact points). This more repeatable force direction results in a more reliable and efficient energy transfer system 80.

The magnitude of the moment created by the force F1 and its direction are designed to overcome all opposing forces, such as, for example, the biasing force exerted on the rotatable member 90 by the biasing member 100 and any frictional forces between the rotational member 90 and the pivot point 20*a*, such that the rotatable member 90 begins to rotate in the direction of arrow A due to the force F1.

The initial impact of the moveable conductive blade 50 on the protrusion 93 of the rotatable member 90 initiates a transfer of energy from the moveable conductive blade 50 to the energy transfer system 80. That is, a portion of the kinetic energy of the moveable conductive blade 50 is transferred to and absorbed by the energy transfer system 80 when the moveable conductive blade 50 initially impacts and contacts the protrusion 93. This transfer of energy to the energy transfer system 80 is advantageous because the kinetic energy of the moveable conductive blade 50 is reduced. Thus, a magnitude of a force exerted on the stationary contact 70 when the moveable contact 60 initially impacts the stationary contact 70 (FIGS. 7A-7C) is reduced as compared to a magnitude of a corresponding force exerted in a circuit breaker without the energy transfer system 80. Reducing the magnitude of the force exerted on the stationary contact reduces the potential for damage to be inflicted on the stationary contact 70 due to, for example, the impact itself, bouncing between the contacts 60, 70 and arcing therebetween, etc.

Referring to FIGS. 6A-6C, the circuit breaker 10 is shown in the second instantaneous-intermediate position as the handle 30 is in the ON position, the moveable conductive blade 50 is dynamic (i.e., moving and/or swinging from the first blade position towards the second blade position) and in a second instantaneous-intermediate-blade position, and the rotatable member 90 is dynamic (i.e., rotating, for example, about 7 degrees with respect to the first member position) and in a second instantaneousis intermediate-member position between the first and the second member positions. In the second instantaneous-intermediate position, even though the handle 30 is in the ON position, current is prevented from flowing through the circuit breaker 10 as the moveable contact 60 is not electrically connected with the stationary contact 70 (FIG. 6A); however, as compared to FIG. 5A, a distance between the moveable contact 60 and the stationary contact 70 is decreased.

As best shown in FIG. 6C, the orthogonal blade surface 55 contacts the planar engagement surface portion 93*b* of the protrusion 93 between points B and C. This contact is a surface-to-surface contact between points B and C as the portion of the orthogonal blade surface 55 that contacts the planar engagement surface portion 93*b* is substantially planar or flat and the planar engagement surface portion 93*b* is substantially planar or flat. This surface-to-surface contact results in an average dynamic force F2 being exerted on the protrusion 93 by the moveable conductive blade 50 in a second force direction perpendicular to a line connecting points B and C. The force F2 and its direction create a moment or torque about the axis of rotation 91 in the direction of arrow B (FIG. 6B) such that the rotatable member 90 continues to rotate from the second instantaneous-intermediate-member position towards the second member position in the direction of arrow B. The moment has a moment arm length MA2 that is defined as a distance between a line through the average dynamic force F2 and a parallel line through the axis of rotation 91. In the second instantaneous-intermediate-member position, the rotatable member 90 is rotated about 25 percent of a total range of rotation of the rotatable member 90 between the first and the second member positions.

Referring to FIGS. 7A-7C, the circuit breaker 10 is shown in the latched-ON position as the handle 30 is in the ON position, the moveable conductive blade 50 is static (i.e., not moving and/or swinging) and in the second blade position, and the rotatable member 90 is static (i.e., not rotating) and in the second member position. In the latched-ON position, current is allowed to flow through the circuit breaker 10 as the moveable contact 60 is electrically connected with the stationary contact 70 (FIG. 7A).

As best shown in FIG. 7C, the orthogonal blade surface 55 contacts the final curved engagement surface portion 93*c* of the protrusion 93 at point D. This contact is a tangential contact at point D as the portion of the orthogonal blade surface 55 that contacts the final curved engagement surface portion 93*c* is substantially curved and the final curved engagement surface portion 93*c* is substantially curved. This point contact results in a static force F3 being exerted on the protrusion 93 by the moveable conductive blade 50 in a third force direction. The force F3 and its direction create a moment or torque about the axis of rotation 91 in the direction of arrow C (FIG. 7B) such that the rotatable member 90 is biased or held in the second member position. The moment has a moment arm length MA3 that is defined as a distance between a line through the force F3 and a parallel line through the axis of rotation 91. In the latched-ON position, the rotatable member 90 is rotated about 100 percent of the total range of rotation of the rotatable member 90 between the first and the second member positions. That is, between the second instantaneous-intermediate-member position and the latched-ON position, the rotatable member 90 is rotated about 75 percent of the total range of rotation of the rotatable member 90. As shown, the total range of rotation of the rotatable member 90 is between about 20 degrees and about 30 degrees. Other ranges are contemplated, such as, for example, between about 20 degrees and about 75 degrees.

Referring to FIGS. 5B, 6B, and 7B, the length of the moment arms MA1, MA2, and MA3 of the respective moments change as the direction of the forces F1, F2, and F3 changes with the rotation of the rotatable member 90 from the first member position (FIG. 5A) to the second member position (FIG. 7C). Thus, different magnitudes of mechanical advantage of the moveable conductive blade 50 over the rotatable member 90 are provided depending on the position of the rotatable member 90. MA3 is larger than MA1 and MA2, which results in a better mechanical advantage when the circuit breaker 10 is in the latched-ON position (FIGS. 7A-7C) as compared to the first instantaneous-intermediate position (FIGS. 5A-5C). MA3 can be between about 10 percent and about 60 percent larger than MA1 and/or MA2. Alternatively, MA3 can be between about 20 percent and about 35 percent larger than MA1 and/or MA2.

In order for a proper electrical connection to be made and maintained between the moveable contact 60 and the stationary contact 70 when the circuit breaker is the ON position, the switch assembly 25 applies a static force that urges the moveable contact 60 into physical and electrical contact with the stationary contact 70. The energy transfer system 80 of the present disclosure is advantageous because it absorbs a portion of the kinetic energy of the moveable conductive blade 50 (i.e., the dynamic force applied to the rotatable member 90) during the switching process without significantly impacting the final physical and electrical engagement between the moveable contact 60 and the stationary contact 70. That is, the energy transfer system 80 exerts a minimal static force on the moveable contact blade 50 in the second blade position such that the proper electrical connection is maintained between the moveable contact 60 and the stationary contact 70 when the circuit breaker is the ON position.

For example, the static force exerted on the orthogonal blade surface 55 by the rotatable member 90 in the second member position is less than 10 percent of a dynamic force exerted on the orthogonal blade surface 55 by the rotatable member 90 when the orthogonal blade surface 55 initially contacts the initial curved engagement surface 93*a* of the protrusion 93 and causes the rotatable member 90 to begin to rotate.

The biasing member 100 is shown in the FIGS. as being a torsion spring. Various other configurations and types of biasing members can be used instead of the biasing member 100. For example, the biasing member can be a coil spring (not shown) coupled between the housing 20 and the rotatable member 90 to bias the rotatable member 90 in the first member position. For another example, the biasing member can be an elastomer member (not shown) positioned between the housing 20 and the rotatable member 90 to bias the rotatable member 90 in the first member position. For yet another example of the biasing member 100, the biasing member can be a leaf spring, such as, for example, a living hinge leaf spring, that is molded into the rotatable member 90 to bias the rotatable member 90 in the first member position, such as, for example, as shown in FIGS. 8A and 8B.

Figure 8A:
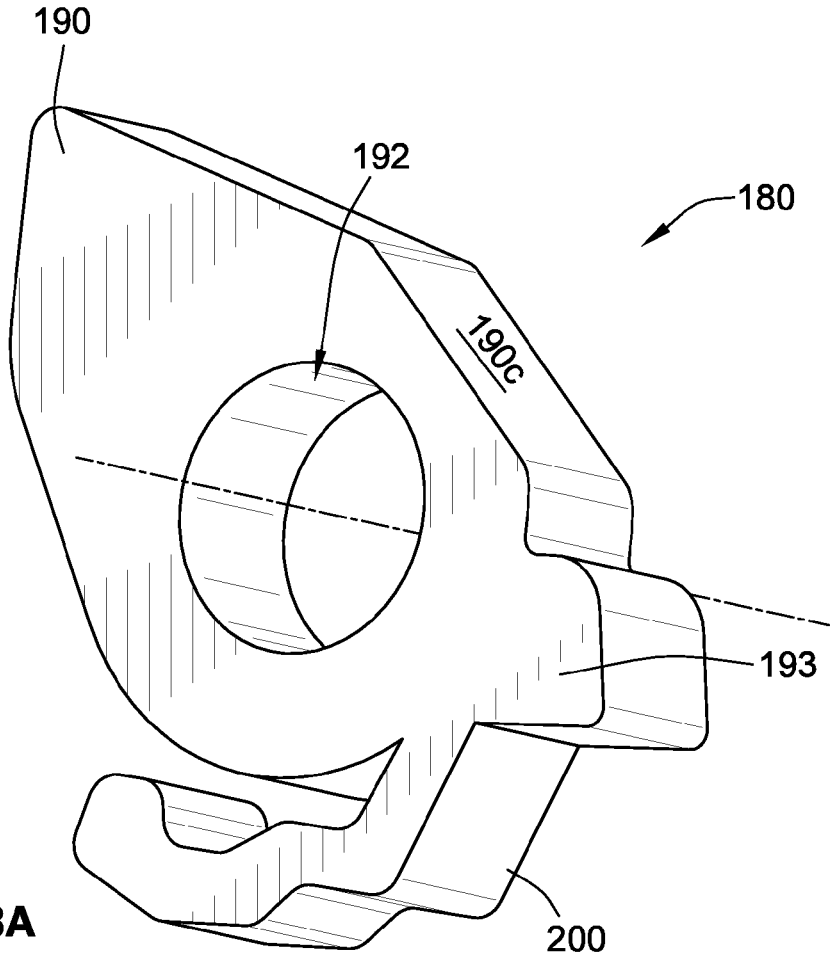
FIG. 8A is a front perspective view of an energy transfer system having a rotatable member with a built in biasing member.
Figure 8B:
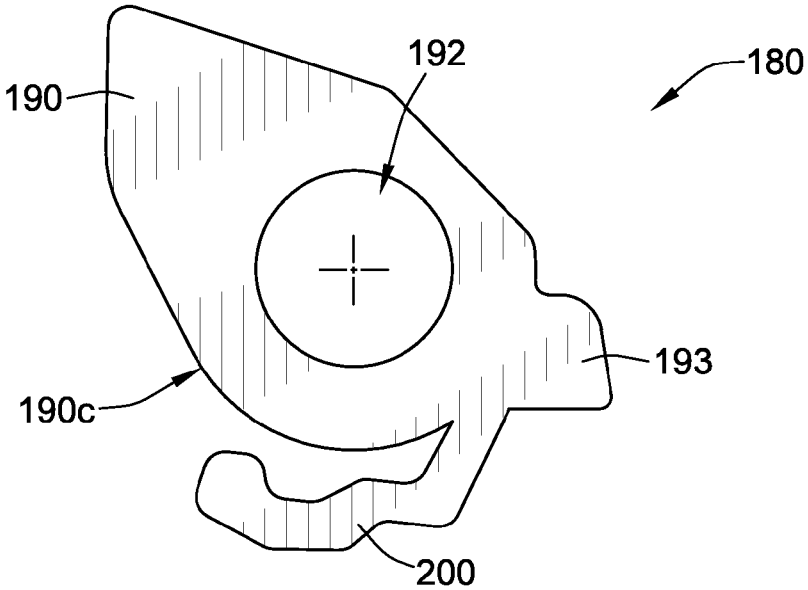
FIG. 8B is a front view of the energy transfer system of FIG. 8A.

Referring to FIGS. 8A and 8B, an energy transfer system 180 includes a rotatable member 190 and a biasing member 200. The biasing member 200 is molded into, and/or as a part of, the rotatable member 190 such that the energy transfer system 180 is a single, unitary part. The single, unitary-part energy transfer system 180 can be used with the circuit breaker 10 described above in the same, or similar, manner as the energy transfer system 80. That is, the rotatable member 190 can be pivotally coupled to the pivot point 20*a* of the housing 20 of the circuit breaker 10 and the biasing member 200 can operatively engage the housing 20 to bias the rotatable member 190 in a first member position.

As compared to the rotatable member 90, the rotatable member 190 is formed without a channel (e.g., channel 95) as the biasing member 200 is integrally formed with the rotatable member 190 and projects and/or extends from a perimeter surface 190*c* of the rotatable member 190 and thus, there is no need for a channel in the rotatable member 190. Additionally, the rotatable member 190 includes an aperture 192 and a protrusion 193 that are the same as, or similar to, the aperture 92 and the protrusion 93 described above in reference to FIGS. 3A-3D.

While the initial and final curved engagement surface portions 93*a* and 93*c* are shown as described as being curved, in some alternatives, these surfaces 93*a,c* can be substantially curved (i.e., some non-curved portion(s)), planar, substantially planar, polygonal, or some combination thereof. Similarly, the planar engagement surface portion 93*b* is shown and described as being planar, but in some alternatives, this surface 93*b* can be substantially planar (i.e., some non-planar portion(s)), curved, substantially curved, polygonal, or some combination thereof.

The moveable conductive member 50 is described above as initially impacting the initial curved engagement surface portion 93*a* of the protrusion 93. Alternatively, instead of initially impacting the initial curved engagement surface portion 93*a*, the switch assembly 25 can be designed such that the moveable conductive member 50 initially impacts the planar engagement surface portion 93*b* of the protrusion 93 and does not impact or contact the initial curved engagement surface portion 93*a* of the protrusion 93 when the circuit breaker 10 is switched from being off to on. In such an alternative, the rotatable member 90 is positioned adjacent to the moveable conductive blade 50 such that as the moveable conductive blade 50 is moved and/or swung from the first blade position to the second blade position, the orthogonal blade surface 55 initially contacts the planar engagement surface portion 93*b* of the protrusion 93 and causes the rotatable member 90 to begin to rotate about the axis of rotation 91 such that the orthogonal blade surface 55 then contacts the final curved engagement surface portion 93*c* of the protrusion 93.

The handle 30 can be urged from the OFF position to the ON position manually by an operator of the circuit breaker 10. Alternatively, the handle 30 can be urged from the OFF position to the ON position automatically by a mechanical controller member (not shown) coupled to the handle 30, such as, for example, a lever, an arm, a pin, etc., or some combination thereof.

Words of degree such as "substantially" or "about" are used herein in the sense of "at, or nearly at, given the process, control, and material limitations inherent in the stated circumstances" and are used herein to keep the unscrupulous infringer from taking advantage of unqualified or absolute values stated for exemplary embodiments.

While particular embodiments and applications of the present disclosure have been illustrated and described, it is to be understood that the disclosure is not limited to the precise construction and compositions disclosed herein and that various modifications, changes, and variations may be apparent from the foregoing descriptions without departing from the spirit and scope of the present disclosure as defined in the appended claims.

What is claimed is:

1. A circuit breaker, comprising:

a housing;

a moveable contact blade positioned within the housing;

a moveable contact directly attached to the moveable contact blade;

a rotatable member pivotally coupled to the housing and having an axis of rotation about which the rotatable member is rotatable, the rotatable member further including a protrusion extending radially with respect to the axis of rotation, the protrusion having a first engagement surface portion and a second engagement surface portion next to the first engagement surface portion, the first engagement surface portion being substantially planar and the second engagement surface portion being substantially curved, the rotatable member being positioned adjacent to the blade such that as the moveable contact blade is moved from a first blade position to a second blade position the blade contacts the first engagement surface portion of the protrusion and causes the rotatable member to rotate about the axis of rotation such that the blade contacts the second engagement surface portion; and a biasing member operatively engaged with the rotatable member and the housing.

2. The circuit breaker of claim 1, wherein the blade further includes a third engagement surface portion next to the first engagement surface portion and distal from the second engagement surface portion, the third engagement surface being substantially curved.

3. The circuit breaker of claim 2, wherein the rotatable member is positioned adjacent to the blade such that as the moveable contact blade is moved from a first blade position to a second blade position the blade initially contacts the third engagement surface portion and causes the rotatable member to begin to rotate about the axis of rotation such that the blade then contacts the first engagement surface portion and continues to rotate such that the blade then contacts the second engagement surface portion.

4. A circuit breaker, comprising:

a handle;

a moveable contact blade operably coupled to the handle such that the moveable contact blade is configured to move from a first blade position to a second blade position in response to the handle being urged from an OFF position to an ON position; and a rotatable member having an axis of rotation about which the rotatable member is rotatable, the rotatable member further including a protrusion extending radially from a perimeter surface of the rotatable member, the protrusion having a first engagement surface portion and a second engagement surface portion next to the first engagement surface portion, the rotatable member being positioned adjacent to the moveable contact blade such that as the blade is moved from the first blade position to the second blade position the blade initially contacts the first engagement surface portion of the protrusion and causes the rotatable member to begin to rotate about the axis of rotation such that the blade then contacts the second engagement surface portion of the protrusion.

5. The circuit breaker of claim 4, wherein the perimeter surface of the rotatable member includes the first and the second engagement surfaces of the protrusion.

6. The circuit breaker of claim 4, wherein the rotatable member is rotatable about the axis of rotation between a first member position and a second member position, and wherein as the moveable contact blade is moved from the first blade position to the second blade position the rotatable member is rotated from the first member position to the second member position.

7. The circuit breaker of claim 6, further comprising a biasing member operatively engaged with the rotatable member to bias the rotatable member towards the first member position.

8. The circuit breaker of claim 7, further comprising a housing, wherein the perimeter surface of the rotatable member further includes a housing engaging surface portion, the biasing member being configured to bias the rotatable member such that the housing engaging surface portion abuts an inside wall of the circuit breaker in response to the rotatable member being in the first member position.

9. A circuit breaker having an ON position for allowing electrical current to flow across the circuit breaker and an OFF position for preventing electrical current from flowing across the circuit breaker, the circuit breaker comprising:

a housing;

a handle having an ON position and an OFF position which correspond with the ON and OFF positions of the circuit breaker;

a trip lever pivotally attached to a pivot point in the housing;

a moveable contact blade operably coupled to the handle and the trip lever such that the moveable contact blade is configured to move from a first blade position to a second blade position in response to the handle being urged from the OFF position to the ON position, the blade having a major blade surface lying in a plane and an orthogonal blade surface extending from the major blade surface in a direction generally perpendicular to the plane;

a moveable contact directly attached to the moveable contact blade;

a stationary contact positioned within the housing and being configured to electrically couple with the moveable contact in response to the blade being in the second blade position; and a rotatable member having an axis of rotation about which the rotatable member is rotatable, the rotatable member further including a protrusion extending radially with respect to the axis of rotation, the protrusion having a first engagement surface portion and a second engagement surface portion next to the first engagement surface portion, the rotatable member being positioned adjacent to the blade such that as the blade is moved from the first blade position to the second blade position the orthogonal blade surface initially contacts the first engagement surface portion of the protrusion and causes the rotatable member to begin to rotate about the axis of rotation such that the orthogonal blade surface then contacts the second engagement surface portion of the protrusion.

10. The circuit breaker of claim 9, wherein the rotatable member is pivotally attached to the pivot point in the housing adjacent to the trip lever.

11. The circuit breaker of claim 9, wherein the rotatable member has a first member position and a second member position, as the moveable contact blade is moved from the first blade position to the second blade position, the rotatable member is moved from the first member position to the second member position.

12. The circuit breaker of claim 11, further comprising a biasing member to bias the rotatable member toward the first member position.

13. The circuit breaker of claim 12, wherein the biasing member is a torsion spring.

14. The circuit breaker of claim 12, wherein the biasing member has a first end and a second end, the first end being operatively engaged with the housing and the second end being operatively engaged with the rotatable member.

15. An energy transfer system for absorbing energy from a moveable conductive blade directly attached to a moveable contact in a circuit breaker, the energy transfer system consisting of:

a rotatable member having an axis of rotation about which the rotatable member is rotatable between a first member position and a second member position, the rotatable member further including a protrusion, the protrusion having a first engagement surface portion and a second engagement surface portion next to the first engagement surface portion, in response to the rotatable member being in the first member position, the first engagement surface is operable to contact the moveable conductive blade to cause the rotatable member to begin to rotate about the axis of rotation such that the moveable conductive blade then contacts the second engagement surface portion of the protrusion; and a biasing member operatively engaged with the rotatable member, the biasing member being configured to bias the rotatable member toward the first member position.

16. The energy transfer system of claim 15, wherein the first engagement surface portion is substantially planar and the second engagement surface portion is substantially curved.

17. The energy transfer system of claim 16, wherein the moveable conductive blade includes a substantially curved surface that is configured to tangentially contact the substantially curved second engagement surface in response to the rotatable member being in the second member position.

18. The energy transfer system of claim 16, wherein the moveable conductive blade includes a substantially curved surface that is configured to tangentially contact the substantially planar first engagement surface in response to the rotatable member being in an intermediate member position between the first and second member positions.

19. The energy transfer system of claim 15, wherein the rotatable member further includes a curved channel operable to receive a portion of the biasing member therein, the curved channel including a base and a curved outer wall, and wherein a portion of the biasing member engages a portion of the outer curved wall to bias the rotatable member toward the first member position.

20. The energy transfer system of claim 15, wherein the rotatable member further includes a housing engaging surface portion, and wherein the biasing member is configured to bias the rotatable member such that the housing engaging surface portion abuts an inside wall of the circuit breaker when the rotatable member is in the first member position.

21. The energy transfer system of claim 15, wherein in response to the blade contacting the second engagement surface portion, the rotatable member is maintained in the second member position.

22. The energy transfer system of claim 15, wherein the protrusion extends radially with respect to the axis of rotation.

23. The energy transfer system of claim 15, wherein the biasing member is formed as an integral part of the rotatable member such that the energy transfer system is a unitary part.

* * * * *